US005816265A

United States Patent [19]

Ringo

[11] Patent Number: 5,816,265

[45] Date of Patent: Oct. 6, 1998

[54] HAIR STYLING FORM

[76] Inventor: Jean Ringo, 1432 103rd Ave., Oakland, Calif. 94603

[21] Appl. No.: 880,147

[22] Filed: Jun. 20, 1997

[51] Int. Cl.[6] ..... A45G 5/00

[52] U.S. Cl. ..... 132/55; 2/DIG. 11

[58] Field of Search ..... 132/55, 53, 54, 132/247; 2/DIG. 11, 171, 209.3, 174

[56] References Cited

U.S. PATENT DOCUMENTS

| | | | |
|---|---|---|---|
| D. 273,341 | 4/1984 | Rol | 2/DIG. 11 |
| 584,593 | 6/1897 | Julier | 132/247 |
| 2,525,981 | 10/1950 | Webster | 132/246 |
| 2,696,007 | 12/1954 | Larkin et al. | 2/171 |
| 2,709,261 | 5/1955 | Kalensky | 2/209.3 |
| 3,076,199 | 2/1963 | Dudley, Jr. | 132/55 |
| 3,471,867 | 10/1969 | Kirchhoff | 2/207 |
| 4,745,933 | 5/1988 | Saenger | 132/53 |
| 5,144,968 | 9/1992 | Rivera | 132/247 |

FOREIGN PATENT DOCUMENTS

| | | | |
|---|---|---|---|
| 1042225 | 10/1953 | France | 132/55 |
| 58617 | 3/1954 | France | 132/55 |

OTHER PUBLICATIONS

Hair styling rolls shown on p. 59 of Jan. 1996 catalog of Gold Medal Hair Products Company.

*Primary Examiner*—Todd E. Manahan
*Assistant Examiner*—Eduardo C. Robert
*Attorney, Agent, or Firm*—Jack Lo

[57] ABSTRACT

A hair styling form includes a foam loop completely covered in a fine nylon netting. The loop has a circular cross section, and has an open center large enough to circle a person's head. To use, hair is combed down from the head, and the styling form is placed around the head near the hairline. Hair is wrapped around the form to create a crown-shaped hair style. The nylon netting provides enough friction or tack for fixing the hair in place, so that no hair pins need to be used. The foam loop is completely enclosed in the nylon netting, so that it will not grab or pull hair during removal.

1 Claim, 1 Drawing Sheet

HAIR STYLING FORM

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field Of The Invention:

This invention relates generally to hair styling accessories.

2. Prior Art:

A popular hair style is a circular roll that resembles a crown or halo. A crown can be done by putting on a ready-made hair piece, but the hair color must be selected to match, and hair pins must be used for fastening the hair piece. A crown can also be done by wrapping hair around a styling form. A typical form comprises a foam cylinder with free ends. The cylinder is bent to encircle the head generally around the hairline, and the hair is wrapped around the cylinder in a bottom-to-top direction. The foam cylinder will straighten immediately whenever released, so that it is very difficult to use. Further, hair tends to get caught in the pores of the foam, so that removing the cylinder causes hair to be pulled out. Another known hair form is for doing a chignon, which is a small bun worn at the back of the head or the nape of the neck. The chignon form comprises a small foam loop made by joining the ends of a short foam cylinder. It has a very small opening in the center, so that it cannot be used for doing a crown. It also has a foam surface, so that it tends to grab and pull hair during removal.

OBJECTS OF THE INVENTION

Accordingly an object of the present invention is to provide a hair styling form for doing a crown-shaped hair style.

Another object of the present invention is to provide a hair styling form that can be put on without hair pins.

Yet another object of the present invention is to provide a hair styling form that does not grab or pull hair.

Further objects of the present invention will become apparent from a consideration of the drawings and ensuing description.

BRIEF SUMMARY OF THE INVENTION

A hair styling form includes a foam roll covered in a fine nylon netting. The ends of the roll are joined together to form a loop large enough to encircle a person's head. To use, hair is combed down from the head, and the styling form is placed around the head near the hairline. Hair is wrapped around the form to create a crown-shaped hair style.

DRAWING REFERENCE NUMERALS

10. Hair Styling Form 11. Foam Loop
12. Fine Nylon Netting 13. End
14.End

DETAILED DESCRIPTION OF THE INVENTION

Figure 1:
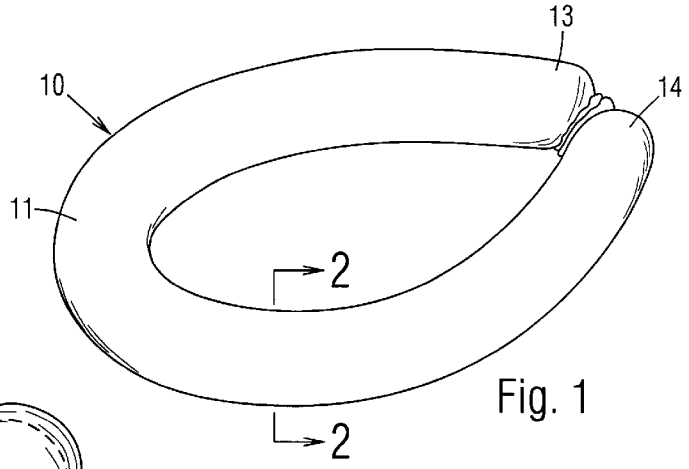
FIG. 1 is a top perspective view of a hair styling form in accordance with the invention.
Figure 2:
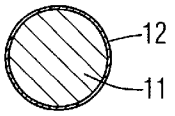
FIG. 2 is a sectional view of the hair styling form.

In accordance with a preferred embodiment of the invention shown in FIGS. 1 and 2, a hair styling form 10 includes a resilient foam loop 11 completely enclosed in a fine nylon netting 12, such as the material commonly used for nylon stockings. Loop 11 preferably has a circular cross section of about 2.5 cm (1 inch) diameter. For low cost, loop 11 is made by joining opposite ends 13 and 14 of a long foam cylinder together. Loop 11 preferably has an open center about 13 cm (5 inches) wide or more for encircling the head of most adults. Hair styling form 10 is preferably provided in different colors, such as black, red, and blond, for matching different hair colors.

Figure 3:
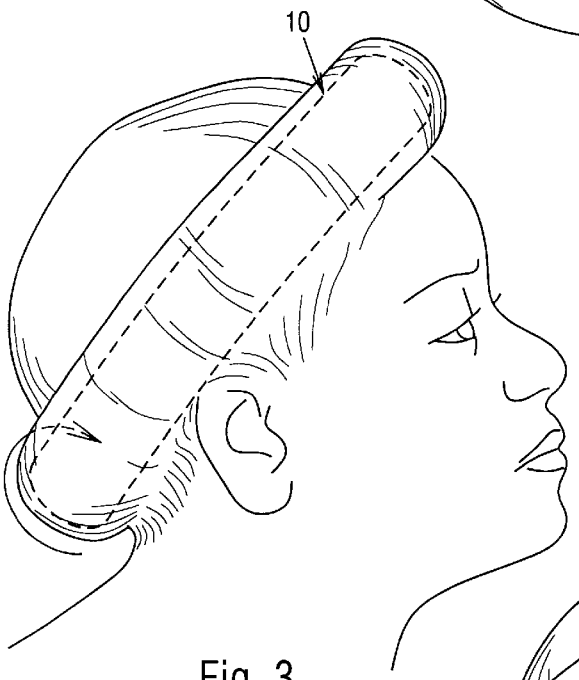
FIG. 3 is a side view of the hair styling form worn on a person.
Figure 4:
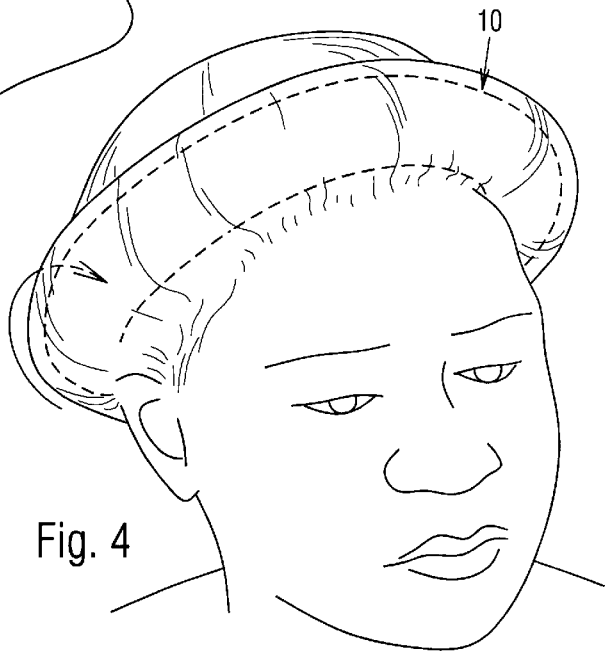
FIG. 4 is a front perspective view of the hair styling form worn on the person.

To use, hair is combed down from the head, and styling form 10 is placed around the head near the hairline. Styling form 10 is sized for encircling the head tightly enough to stay in place. Hair is wrapped upwardly around form 10 in the direction indicated by the arrows in FIGS. 3 and 4, and tucked in between form 10 and the head until a crown-shaped hair style is created. The circular cross section of form 10 provides a full, rounded hair style. Nylon netting 12 provides enough friction or tack for fixing the hair in place, so that no hair pins need to be used. Foam loop 11 is completely enclosed in fine netting 12, so that loop 11 will not grab or pull hair during removal. Netting 12 is less tacky than foam loop 11, so that it will also not grab or pull hair.

Summary And Scope

Accordingly, I have provided a hair styling form for doing a crown-shaped hair style. It can be put on without hair pins, and it does not grab or pull hair.

Although the above descriptions are specific, they should not be considered as limitations on the scope of the invention, but only as examples of the embodiments. Many substitutes and variations are possible within the teachings of the invention. For example, other tacky fabrics may be used for covering foam loop 11. A cotton sheet may be placed between netting 12 and foam loop 11. Styling form 10 may be provided in other sizes for encircling different size heads. The diameter of loop 11 may be varied. Instead of being plain, styling form 10 may include a sculpted surface for added ornamentation. The joint of loop 11 may be releasably connected, or adjustably connected for varying the width of form 10. The loop may be molded instead of being made by joining the ends of a straight roll. Loop 11 may be made of other suitable materials, such as a stuffed fabric tube. Therefore, the scope of the invention should be determined by the appended claims and their legal equivalents, not by the examples given.

I claim:

1. A hair styling form, comprising:

a foam cylinder having opposite ends releasably connected together; and a nylon netting enclosing said foam cylinder, said nylon netting at said opposite ends of said foam cylinder being releasably connected together, so that said opposite ends of said foam cylinder are in abutting engagement, and said foam cylinder is formed into a foam loop with an open center free of said nylon netting, said foam loop for doing a hair style by wrapping hair around said foam loop, said nylon netting being tacky enough for fixing the hair in position, said nylon netting for isolating the hair from said foam loop to prevent said foam loop from grabbing and pulling the hair.

* * * * *